US007409776B2

(12) United States Patent
Ono et al.

(10) Patent No.: US 7,409,776 B2
(45) **Date of Patent: *Aug. 12, 2008**

(54) DRYING MACHINE WITH INNER AND OUTER DRUMS AND OUTSIDE AIR INTRODUCTION

(75) Inventors: Koji Ono, Oizumi-machi (JP); Kazuyoshi Tomochika, Oizumi-machi (JP)

(73) Assignee: Sanyo Electric Co., Ltd., Osaka (JP)

( * ) Notice: Subject to any disclaimer, the term of this patent is extended or adjusted under 35 U.S.C. 154(b) by 50 days.

This patent is subject to a terminal disclaimer.

(21) Appl. No.: 11/073,723

(22) Filed: Mar. 8, 2005

(65) Prior Publication Data

US 2005/0198852 A1 Sep. 15, 2005

(30) Foreign Application Priority Data

Mar. 10, 2004 (JP) ..... 2004-067385

(51) Int. Cl.
*F26B 11/02* (2006.01)

(52) U.S. Cl. ..... 34/77; 34/606

(58) Field of Classification Search ..... 34/77, 34/78, 79, 80, 87, 90, 606
See application file for complete search history.

(56) References Cited

U.S. PATENT DOCUMENTS 3,750,304 A * 8/1973 Ghadiali ..... 34/566
4,471,537 A * 9/1984 Meda ..... 34/77
4,603,489 A * 8/1986 Goldberg ..... 34/77
4,640,022 A * 2/1987 Suzuki et al. ..... 34/552
5,151,119 A * 9/1992 Clements et al. ..... 65/84
6,938,356 B2 * 9/2005 Nagae et al. ..... 34/77
2001/0049883 A1 * 12/2001 Ryden ..... 34/104

FOREIGN PATENT DOCUMENTS

| | | |
|---|---|---|
| JP | 10-033896 | 2/1998 |
| JP | 10-89843 | 4/1998 |
| JP | 10-211383 | 8/1998 |
| JP | 11-099299 | 4/1999 |
| JP | 11-244587 | 9/1999 |
| JP | 2000-107491 | 4/2000 |
| JP | 2000-157786 | 6/2000 |
| JP | 2003-053089 | 2/2003 |
| JP | 2003-265880 | 9/2003 |
| JP | 2004-236965 | 8/2004 |
| JP | 2001-062194 | 3/2005 |

* cited by examiner

*Primary Examiner*—S. Gravini
(74) *Attorney, Agent, or Firm*—McDermott Will & Emery LLP

(57) ABSTRACT

An object is to provide a drying machine capable of maintaining air discharged into a housing chamber while efficiently drying a matter to be dried in a short time. A drying machine provided with a housing chamber which houses the matter to be dried, and executing a drying operation of the matter to be dried in the housing chamber comprises: a gas cooler; an evaporator; a blower fan; an air circulation path for discharging air heated by the gas cooler into the housing chamber by the blower fan, sending the air passed through the housing chamber into the evaporator, and circulating the air in the gas cooler; and a closeable outside air introduction port for mixing outside air with the air circulating in the air circulation path.

8 Claims, 3 Drawing Sheets

DRYING MACHINE WITH INNER AND OUTER DRUMS AND OUTSIDE AIR INTRODUCTION

BACKGROUND OF THE INVENTION

The present invention relates to a drying machine which comprises a housing chamber for housing a matter to be dried and which executes a drying operation of the matter to be dried in the housing chamber.

In a drying machine, an electric heater or a gas burning heater has heretofore been used as a heat source, outside air is heated by the electric heater or the burning heater to thereby form the air at high temperature, thereafter the air is blown into a housing chamber in which a matter to be dried such as clothing is housed, and the matter to be dried in the housing chamber is dried.

However, in the drying machine, since the electric heater, the gas burning heater or the like is used as a heat source, energy consumption for drying the matter to be dried increases, and there has been a problem that energy costs such as electricity and gas charges soar.

To solve the problem, a clothing drying machine has been developed which a heat pump constituted of a refrigerant circuit including a compressor, a heating coil, an expansion valve, and a cooling coil and capable of circulating a heat exchange medium is utilized. The matter to be dried is dried by high-temperature air heated by the heating coil, and humidity evaporated from the dried matter is condensed by the cooling coil, and discarded (see Japanese Patent Application Laid-Open Nos. 2001-62194 and 2003-53089).

To dry the matter to be dried in this drying machine, there are: an inner air circulation system (see Patent Documents 1 and 2) for discharging air whose heat has been changed with the radiator into a housing chamber by a blower, allowing the air passed through the housing chamber to exchange heat with the evaporator, thereafter returning the air again into the radiator, and discharging the air into the housing chamber; and an outer air introduction system (see Japanese Patent Application Laid-Open No. 11-99299) for introducing air from the outside of a drier, exchanging heat with the radiator, discharging the air into the housing chamber, allowing the air passed through the housing chamber to exchange heat with the evaporator, and discharging the air to the outside. There is also a system in which a part of an air circulation system communicates with the atmosphere (see Japanese Patent Application Laid-Open No. 10-33896).

However, in the former inner circulation system, the air discharged into the housing chamber can be at high temperature. However, a large amount of water content is contained in the air which has dried the matter to be dried especially in an initial stage of a drying operation. Therefore, all water contents cannot be recovered by the evaporator. Since humidity-containing air is sent into the housing chamber, there has occurred a problem that drying efficiency drops.

Moreover, a compressor having a large capacity has to be used for recovering the large amount of water content in the initial stage of the drying operation by the evaporator, and there has occurred a problem that power consumption increases.

On the other hand, in the latter outer air introduction system, the temperature of the air discharged into the housing chamber depends on an outside air temperature, the discharged air for use in the drying cannot be easily set at the high temperature especially when outside air is at low temperature, and there is a problem that much time is required for drying the matter to be dried. Therefore, the electric heater or the compressor having a large capacity needs to be used in the same manner as described above in order to shorten a drying time, and there occurs a problem that the power consumption increases.

Moreover, to solve both the problems, even when a part of the air circulation system communicates with the atmosphere as described above, circulating air cannot be sufficiently replaced, because outside air is introduced and discharged through one opening.

SUMMARY OF THE INVENTION

The present invention has been developed in order to solve the conventional technique problems, and an object thereof is to provide a drying machine which maintains air discharged into a housing chamber at high temperature while efficiently drying a matter to be dried.

That is, according to the present invention, there is provided a drying machine provided with a housing chamber which houses a matter to be dried, and executing a drying operation of the matter to be dried in the housing chamber, the drying machine comprising: heating means; dehumidifying means; blowing means; an air circulation path for discharging air heated by the heating means into the housing chamber by the blowing means, sending the air passed through the housing chamber into the dehumidifying means, and circulating the air in the heating means; and an outside air introduction port for mixing outside air with the air circulating in the air circulation path.

Moreover, in the drying machine of the present invention, in the above-described invention, the outside air introduction port is closably formed.

According to the present invention, the drying machine comprises the housing chamber which houses the matter to be dried, and executes the drying operation of the matter to be dried in the housing chamber. The machine comprises: the heating means; the dehumidifying means; the blowing means; the air circulation path for discharging the air heated by the heating means into the housing chamber by the blowing means, sending the air passed through the housing chamber into the dehumidifying means, and circulating the air in the heating means; and the outside air introduction port for mixing outside air with the air circulating in the air circulation path. Therefore, for example, when the outside air introduction port is closably formed, the temperature of the air discharged into the housing chamber can be raised. This advantage of the circulation system is maintained, while the dry outside air is introduced and mixed into the circulating air. Accordingly, a water content which has to be recovered by the dehumidifying means is reduced, and the matter to be dried can be efficiently dried in a short time.

Moreover, in the drying machine of the present invention, in the above-described inventions, the drying machine further comprises a refrigerant circuit constituted by successively piping/connecting a compressor, a gas cooler, a pressure reducing device, and an evaporator in an annular shape, the gas cooler constituting the heating means, the evaporator constituting the dehumidifying means.

According to the present invention, in addition to the above-described invention, the drying machine comprises the refrigerant circuit constituted by successively piping/connecting the compressor, gas cooler, pressure reducing device, and evaporator in the annular shape, the gas cooler constitutes the heating means, and the evaporator constitutes the dehumidifying means. Therefore, energy efficiency is enhanced, and the constitution can further contribute to energy saving, for example, as compared with a case where circulating air is heated by an electric heater, and dehumidification is performed by water cooling.

Moreover, in the drying machine according to the present invention, in the above-described inventions, the outside air introduction port is disposed between the housing chamber and a suction side of the blowing means.

According to the present invention, in addition to the above-described invention, since the outside air introduction port is disposed between the housing chamber and the suction side of the blowing means, high-temperature air heated by the heating means is discharged into the housing chamber, while the outside air can be smoothly introduced from the outside air introduction port by the blowing means.

Moreover, in the drying machine of the present invention, in the above-described invention, the outside air introduction port is disposed between the housing chamber and the dehumidifying means.

According to the present invention, in addition to the above-described invention, since the outside air introduction port is disposed between the housing chamber and the dehumidifying means, the introduced outside air can be dehumidified by the dehumidifying means, and sent into the heating means, and drying efficiency of the matter to be dried can be further improved.

Furthermore, the drying machine of the present invention further comprises: waste thread removing means which is disposed between the housing chamber and the dehumidifying means and which removes waste thread in a circulating air, and the outside air introduction port is disposed on an air downstream side of the waste thread removing means.

According to the present invention, additionally, the drying machine comprises the waste thread removing means which is disposed between the housing chamber and the dehumidifying means and which removes the waste thread in the circulating air, and the outside air introduction port is disposed on the air downstream side of the waste thread removing means. Therefore, a disadvantage that the outside air introduction port is clogged with the waste thread in the circulating air can be solved.

Moreover, in the drying machine of the present invention, in the above-described inventions, an outside air introduction amount from the outside air introduction port is adjustable.

According to the present invention, in addition to the above-described inventions, since the outside air introduction amount from the outside air introduction port is adjustable, the outside air introduction amount from the outside air introduction port is adjusted in accordance with temperature•humidity of the outside air, and amount, type or the like of the matter to be dried, and the outside air can be exactly introduced.

Moreover, in the above-described inventions, the drying machine of the present invention further comprises an openable/closeable lid for inserting/removing the matter to be dried with respect to the housing chamber, and a part of the circulating air flows out of a lid portion.

According to the present invention, in addition to the above-described inventions, the drying machine comprises the openable/closeable lid for inserting/removing the matter to be dried with respect to the housing chamber, and a part of the circulating air flows out of the lid portion. Therefore, it is not necessary to dispose a special air outflow portion for discharging a part of the circulating air.

DETAILED DESCRIPTION OF THE PREFERRED EMBODIMENTS

Embodiments of the present invention will be described hereinafter in detail with reference to the drawings.

Embodiment 1

Figure 1:
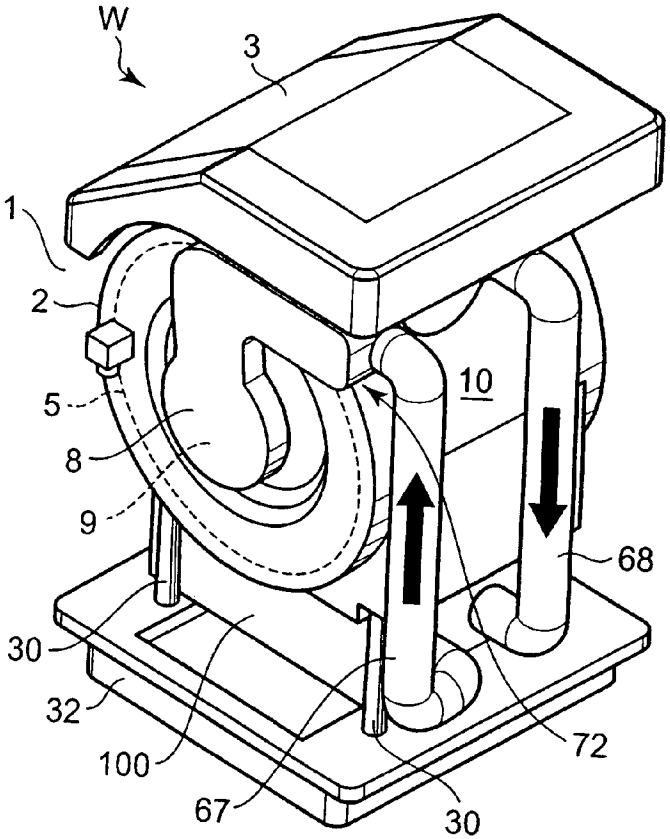
FIG. 1 is a perspective view showing an inner constitution of a washing/drying machine according to an embodiment of the present invention.
Figure 2:
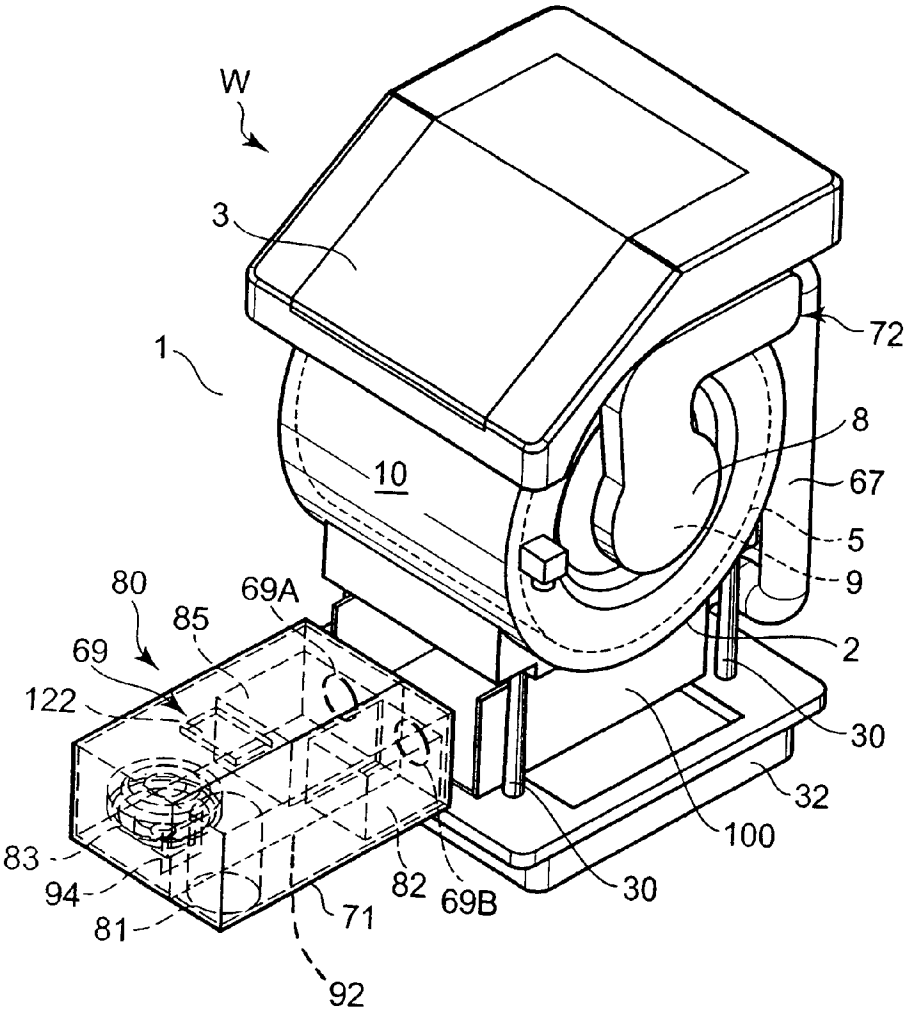
FIG. 2 is a perspective view showing an inner constitution of the washing/drying machine of FIG. 1 in a state in which a duct box is removed.
Figure 3:
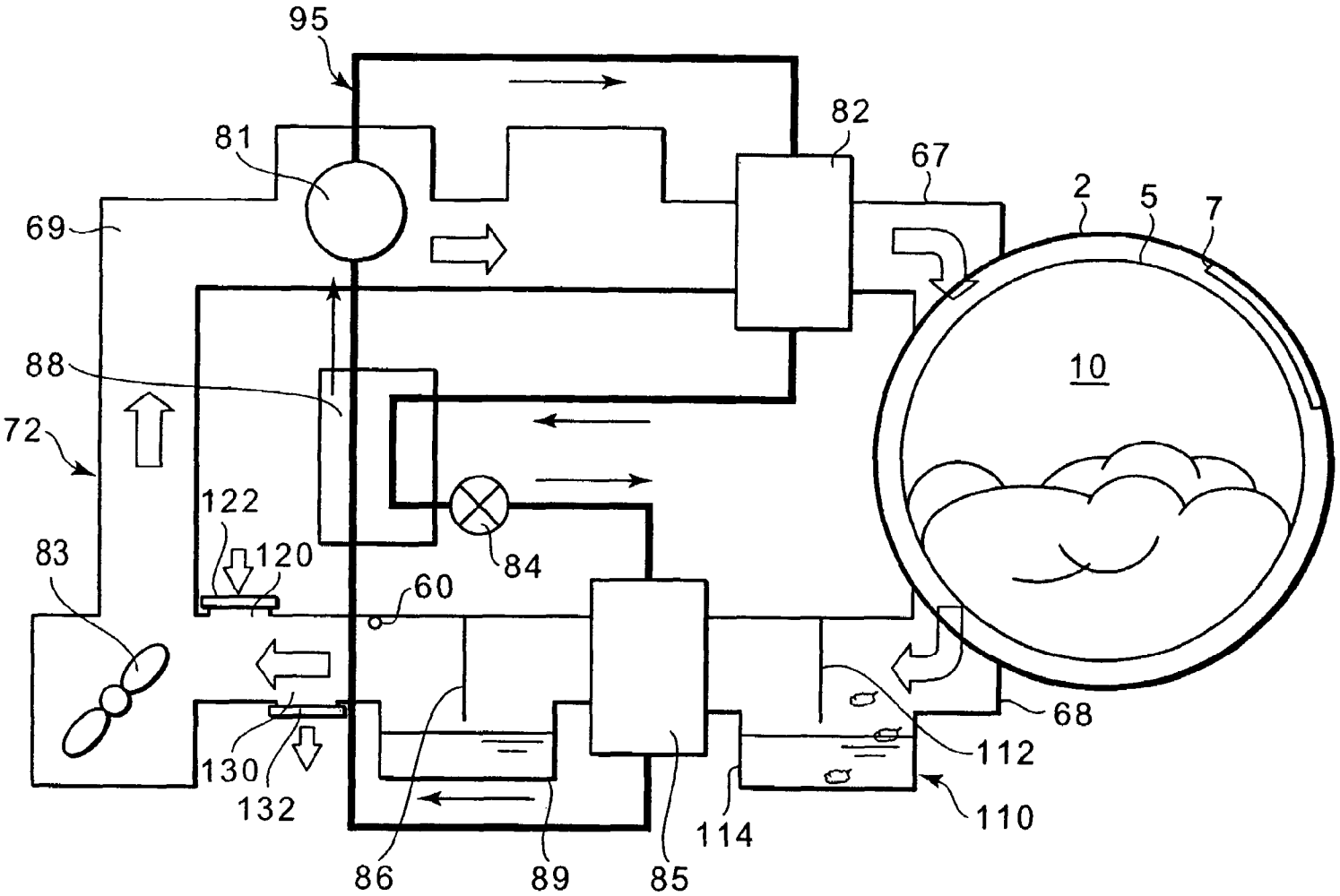
FIG. 3 is a diagram showing flows of a refrigerant and air in the washing/drying machine of FIG. 1.

FIG. 1 is an inner constitution diagram of a washing/drying machine W which executes a washing operation and a drying operation after ending the washing operation according to an embodiment of a drying machine to which the present invention is applied, FIG. 2 is an inner constitution diagram of the washing/drying machine W in a state in which a duct box 71 is taken out, and FIG. 3 is a diagram showing flows of refrigerant and drying air of the washing/drying machine W. The washing/drying machine W of the present embodiment is used for washing and drying a matter to be washed such as clothing (this matter to be washed constitutes a matter to be dried in the drying operation). An open/close door 3 for inserting/removing the matter to be washed is attached to an upper surface middle part of a main body 1 (a case of the main body 1 is seen through in the drawing) forming an outer body. An operation panel (not shown) on which various operation switches and display portions are arranged is disposed on the upper surface of the main body 1 beside the open/close door 3.

In the main body 1, an outer drum 2 capable of storing water and formed of a cylindrical resin is disposed, and the outer drum 2 is disposed along a cylinder axis which is a right/left direction. An inner drum (rotary drum in the present invention) 5 functioning both as a washing tank and dewatering tank and formed of cylindrical stainless steel is disposed inside the outer drum 2. The inside of the inner drum 5 is constituted as a housing chamber (functioning as a housing chamber in a drying operation) 10 which houses the matter to be washed. This chamber is disposed along a cylinder axis which is a right/left direction. A shaft is connected to a shaft 8 of a driving motor (not shown) attached to the side wall (inner side of FIG. 1) of the outer drum 2. The inner drum 5 is rotatably held in the outer drum 2 centering on the shaft of the inner drum 5 connected to the shaft 8.

Moreover, the outer drum 2 causes vibration•displacement by the rotation of the inner drum 5, and is therefore fixed onto a base 32 positioned in the bottom face of the main body 1 via a suspension 30 having a vibration absorption function in order to reduce vibration•noise. That is, the rotating inner drum 5 is attached onto the base 32 via the outer drum 2 and the suspension 30.

A watertight open/close lid 7 for inserting/removing the matter to be washed is disposed facing the open/close door 3 in an upper part of the outer drum 2. A large number of through holes (not shown) through which air and water can circulate are formed in a whole peripheral wall of the inner drum 5. A stop position of the inner drum 5 is defined, and an open/close lid (not shown) for inserting/removing the matter to be washed is disposed in a position (upper surface) facing the open/close lid 7 of the outer drum 2 at a stop time.

The driving motor is a motor for rotating the inner drum 5 centering on the shaft 8 of a right/left horizontal direction in the washing operation and the drying operation after ending the washing operation. This driving motor is attached to the other end (inner side of FIG. 1) of the shaft 8, and the inner drum 5 is controlled in such a manner as to be rotated by a control device (not shown) at a low speed at a drying operation time as compared with a washing operation time.

An inner hollow portion 9 is formed in one end (front side of FIG. 1) of the shaft 8, and an air circulation path 72 described later communicates with the inside of the inner drum 5 via a discharge port of the hollow portion 9.

A water supply passage (not shown) which is water supply means for supplying water into the inner drum 5 is disposed in an upper part of the main body 1. One end of the water supply passage is connected to a supply water source such as city water via a water supply valve. This water supply valve is controlled to open/close by the control device. The other end of the water supply passage is connected to the outer drum 2, and communicates with the inside. When the water supply valve is opened by the control device, the water (city water) is supplied into the housing chamber 10 in the inner drum 5 disposed inside the outer drum 2 from the supply water source.

Moreover, a water discharge passage (not shown) which is water discharge means for discharging water of the housing chamber 10 in the inner drum 5 is disposed in a lower part of the main body 1, and one end of the water discharge passage communicates with a bottom part of the outer drum 2 via a water discharge valve controlled to open/close by the control device. The other end of the water discharge passage is derived to the outside of the washing/drying machine W, and extends to a water discharge trench and the like.

On the other hand, the air circulation path 72 is constituted sideways from a rear side of the outer drum 2 in the main body 1 of the washing/drying machine W. In this air circulation path 72, air heated by a gas cooler 82 which is heating means is discharged into the housing chamber 10 by a blower fan 83 which is blowing means. The air passed through the housing chamber 10 is sent to an evaporator 85 which is dehumidifying means, and again circulated in the gas cooler 82 which is the heating means. The air circulation path 72 comprises a duct member 67 on a discharge side, a duct member 68 on a suction side, an air passage 69 formed in the duct box 71 and the like. One end of the duct member 67 is connected/fixed to the outer drum 2 in such a manner as to communicate with the inside of the inner drum 5 (housing chamber 10) via the discharge port of the hollow portion 9 formed in one end (front side of FIG. 1) of the shaft 8, and the other end thereof is connected/fixed to an outlet 69B of the air passage 69 formed in the duct box 71. One end of the duct member 68 is connected/fixed to the outer drum 2 in such a manner as to communicate with the inside of the inner drum 5 (housing chamber 10) in the outer drum 2, and the other end thereof is connected/fixed to an inlet 69A of the air passage 69. It is to be noted that both the duct members 67, 68 constituting the air circulation path 72 are formed of metals or heat-resistant synthetic resins.

On the other hand, in the duct box 71, a drying unit 80 is housed comprising: a refrigerant circuit 95 constituted by successively piping/connecting a compressor 81, the gas cooler 82, en expansion valve 84 which is a pressure reducing device, the evaporator 85 and the like in an annular shape; and the blower fan 83. Moreover, in the washing/drying machine W of the present embodiment, as described above, the blower fan 83 constitutes heating means, and the evaporator 85 constitutes dehumidifying means. The compressor 81, gas cooler 82, expansion valve 84 (not shown in FIG. 2), evaporator 85, and blower fan 83 are disposed in the air passage 69 formed in the duct box 71. It is to be noted that the refrigerant circuit 95 is also provided with an inner heat exchanger 88 for allowing a refrigerant on a high-pressure side compressed by the compressor 81 and discharged from the gas cooler to exchange heat with a refrigerant on a low-pressure side discharged from the evaporator 85, and the inner heat exchanger 88 is also disposed in the duct box 71.

The blower fan 83 supplies drying air in the air circulation path 72 to the housing chamber 10 in the inner drum 5 from the duct member 67 of the air circulation path 72 via a discharge port of the hollow portion 9 of the shaft 8. That is, in the washing/drying machine W, the drying air in the air circulation path 72 is circulated in the inner drum 5 by the blower fan 83 at a drying operation time, and accordingly the drying air heated by the heat exchange with the gas cooler 82 disposed in the air passage 69 of the air circulation path 72 is discharged into the housing chamber 10 in the inner drum 5.

Moreover, the inlet 69A and the outlet 69B of the air passage 69 are formed in one side surface (innermost positioned face in FIG. 2) of the duct box 71. The inlet 69A is connected/fixed to the duct member 68, and the outlet 69B is connected/fixed to the duct member 67.

Moreover, the inside of the duct box 71 is divided by an insulating partition member 92, the inlet 69A of the air passage 69 is positioned in one of the duct boxes 71 divided by the partition member 92, and the outlet 69B of the air passage 69 is positioned in the other box. Furthermore, in FIG. 2, a communication hole 94 for connecting one duct box 71 to the other duct box 71 divided by the partition members 92 is formed in the front partition member 92 in the duct box 71. Accordingly, in the duct box 71, the air sucked into one duct box 71 from the inlet 69A enters the other duct box 71 via the communication hole 94, and a series of air passage 69 discharged from the outlet 69B is constituted.

Moreover, the evaporator 85 is disposed inside one (left-side in FIG. 2) duct box 71 divided by the partition member 92, and the blower fan 83 is disposed in front. The blower fan 83 is disposed adjacent to the communication hole 94, a suction port is disposed on the side of the evaporator 85, and a discharge port is disposed on the side of the communication hole 94.

Furthermore, the gas cooler 82 is disposed inside the other (right-side in FIG. 2) duct box 71 divided by the partition member 92, and the compressor 81 is disposed in front. The compressor 81 is disposed adjacent to the communication hole 94. That is, the compressor 81 is disposed in such a manner that the air discharged from the blower fan 83 passes through the compressor 81 via the communication hole 94.

By this constitution, the air which has circulated in the housing chamber 10 by the operation of the blower fan 83 and which has dried the matter to be washed flows into the air passage 69 in one duct box 71 divided by the partition member 92 from the inlet 69A via the duct member 68 of the air circulation path 72. The air exchanges heat with the evaporator 85, and is cooled and dehumidified. Thereafter, the air is sucked into the blower fan 83 disposed in the front air passage 69, discharged into the other duct box 71 from the communication hole 94, passed around the compressor 81, heated by the heat exchange with the gas cooler 82, and discharged into the housing chamber 10 from the outlet 69B via the duct member 67.

Here, a waste thread removing device 110 which is waste thread removing means is attached in the duct member 68. The waste thread removing device 110 removes waste thread discharged into the circulating air from the matter to be dried in the housing chamber 10 at a drying operation time, and is disposed in a lower part in the duct member 68 between the housing chamber 10 and the evaporator 85.

The waste thread removing device 110 comprises a wall 112 for partially interrupting the circulating air, and a tank 114 formed in the lower part of the wall 112. Water is pooled in the tank 114 leaving a predetermined space from the wall 112, capable of passing the circulating air.

Moreover, an outside air introduction port 120 is disposed between the housing chamber 10 and a suction side of the blower fan 83 and in the air passage 69 on an air downstream side of the waste thread removing device 110. The outside air introduction port 120 is a port for mixing the air circulating in the air circulation path 72 with the outside air, and the outside air introduction port 120 is formed in the duct box 71. That is, in the present embodiment, the outside air introduction port 120 is a port for connecting the air passage 69 formed in the duct box 71 to the outside of the duct box 71. Moreover, a lid member 122 is attached to the opening of the outside air introduction port 120, and the outside air introduction port 120 can be opened/closed by the lid member 122. Opening/closing and open degree of the lid member 122 are controlled by the lid member 122. That is, the control device controls the opening/closing and open degree of the lid member 122 based on temperature and humidity of outside air detected by a sensor 60 (not shown in FIG. 2) described later and an outside air sensor. Accordingly, an outside air introduction amount from the outside air introduction port 120 can be adjusted. When the lid member 122 is fully opened, 60% or 70% of the circulating air of the air circulation path 72 can be introduced from the outside air introduction port 120. That is, when the opening/closing and open degree of the lid member 122 are controlled, 0% to 70% of the circulating air of the air circulation path 72 can be introduced from the outside air introduction port 120.

On the other hand, an inner air discharge port 130 (not shown in FIG. 2) is disposed in the air passage 69 on an air upstream side of the outside air introduction port 120. The inner air discharge port 130 is a port for discharging a part of the air circulating in the air circulation path 72 to the outside, and the inner air discharge port 130 is formed in the duct box 71. Moreover, a lid member 132 is openably attached to the inner air discharge port 130. The opening/closing and open degree of the lid member 132 are also controlled by the control device. That is, the control device controls the open degree of the lid member 132 in accordance with the temperature and humidity detected by the sensor 60 and the outside air sensor, and can adjust a discharge amount of the circulating air discharged from the inner air discharge port 130.

Moreover, the sensor 60 for detecting the temperature and humidity of drying air (circulating air) in the air passage 69 is disposed on an air downstream side of the evaporator 85 in the air passage 69 and on an air upstream side of the inner air discharge port 130. The outside air sensor (not shown) for detecting the temperature (outside air temperature) and humidity outside the washing/drying machine W is disposed on a side wall of the main body 1 of the washing/drying machine W, or on a back face of the main body. Moreover, outputs of the sensor 60 and the outside air sensor are connected to the control device.

On the other hand, an installation base 100 is attached under the outer drum 2. This installation base 100 is a base for detachably attaching the duct box 71 housing the drying unit 80 under the outer drum 2. The front face of the installation base 100 is open.

Moreover, two holes (not shown) are formed in the rear face of the installation base 100, the duct member 67 on the discharge side is inserted/fixed in one hole, and the duct member 68 on the suction side is inserted/fixed in the other hole.

Furthermore, the duct box 71 in which the drying unit 80 is housed is inserted into a predetermined position from the front-face opening of the installation base 100. By this inserting operation, the respective duct members 67, 68 are connected/fixed to the outlet 69B and the inlet 69A of the air passage 69, and the air circulation path 72 is thereby constituted.

A predetermined amount of carbon dioxide ($CO_2$) which is a refrigerant is sealed in the refrigerant circuit 95, and the refrigerant circuit 95 has a supercritical pressure on a high-pressure side.

It is to be noted that the above-described control device is control means for controlling the washing/drying machine W, and controls operation of the driving motor (not shown), opening/closing of the water supply valve of the water supply passage, opening/closing of the water discharge valve of the water discharge passage, operation of the compressor 81, throttle adjustment of the expansion valve 84, and air amount of the blower fan 83. Furthermore, the control device also controls the temperature of the drying air passed through the gas cooler 82 in such a manner as to prevent the matter to be washed housed in the inner drum 5 from being discolored or damaged.

Furthermore, the control device controls the opening/closing and open degrees of the lid member 122 of the outside air introduction port 120 and the lid member 132 of the inner air discharge port 130 based on the outputs of the sensor 60 and the outside air sensor as described above.

Next, an operation of the washing/drying machine W constituted as described above will be described. The matter to be washed and a predetermined amount of detergent in accordance with the amount of the matter to be washed are projected into the housing chamber 10 in the inner drum 5, a power switch and a start switch among the operation switches are operated, and then the control device starts the washing operation. Moreover, the control device opens the water supply valve of the water supply passage (not shown) to thereby open the water supply passage. Accordingly, the water is supplied into the housing chamber 10 of the inner drum 5 in the outer drum 2 from the supply water source. It is to be noted that at this time, the water discharge valve of the water discharge passage is closed by the control device. In the washing operation, the lid member 122 of the outside air introduction port 120 and the lid member 132 of the inner air discharge port 130 formed in the duct box 71 are totally closed by the control device.

When a predetermined amount of water is accumulated in the housing chamber 10 in the inner drum 5, the control device closes the water supply valve to thereby close the water supply passage. Accordingly, the supply of the water from the supply water source is stopped.

Next, the driving motor formed on the side face of the main body 1 is energized/started by the control device, and the shaft 8 rotates. Accordingly, the inner drum 5 attached to the shaft 8 starts rotating in the outer drum 2, and a washing process of the washing operation is started.

After elapse of a predetermined time after starting the washing process, the driving motor is stopped by the control device, the water discharge valve of the water discharge passage is opened, and the water (washing water) in the housing chamber 10 (i.e., in the outer drum 2) of the inner drum 5 is discharged.

Furthermore, when the water in the housing chamber 10 of the inner drum 5 is discharged, the control device operates the driving motor again, and the matter to be washed is dewatered. After executing the dewatering for a predetermined time, the control device closes the water discharge valve of the water discharge passage.

Next, the control device shifts to a rinsing process, and opens the water supply valve of the water supply passage to thereby open the water supply passage. Accordingly, the water is supplied to the housing chamber 10 in the inner drum 5 from the supply water source again. When a predetermined amount of water is supplied to the housing chamber 10 in the inner drum 5, the control device closes the water supply valve to thereby close the water supply passage. Accordingly, the water supply from the supply water source is stopped.

Moreover, after repeating a rotation operation of the driving motor for a predetermined time to thereby perform the rinsing, the control device stops the driving motor, and opens the water discharge valve of the water discharge passage to thereby discharge the rinsing water in the housing chamber 10 to the water discharge passage. When the rinsing water in the housing chamber 10 is discharged, the control device operates the driving motor again, rotates the inner drum 5 as described above, and shifts to a dewatering process to remove water from the matter to be washed.

After executing this dewatering process for a predetermined time, the control device closes the water discharge valve. The control device starts the compressor 81, and starts the operation of the blower fan 83. Moreover, the inner drum 5 is rotated by the driving motor to shift to the drying operation.

In the drying operation, a high-temperature•pressure gas refrigerant compressed and discharged from the compressor 81 emits heat in the gas cooler 82, and thereafter passes through the inner heat exchanger 88. In the inner heat exchanger 88, heat of the refrigerant on the high-pressure side is taken by the refrigerant on the low-pressure side discharged from the evaporator 85 to thereby radiate further heat. Consequently, an evaporation temperature in the evaporator 85 can be lowered, and a cooling capability can be enhanced. Moreover, the refrigerant which has flown out of the inner heat exchanger 88 reaches the expansion valve 84. The refrigerant does not condense, and the refrigerant circuit 95 indicates a supercritical pressure on the high-pressure side. The refrigerant which has reached the expansion valve 84 is decompressed, and liquefied in the process. Next, the refrigerant flows into the evaporator 85, absorbs heat from a surrounding area, and evaporates. The refrigerant which has flown out of the evaporator 85 passes through the inner heat exchanger 88. Here, the refrigerant which has flown out of the evaporator 85 does not have a complete gas state, and is sometimes mixed with a liquid refrigerant. The refrigerant is passed through the inner heat exchanger 88, and allowed to exchange heat with the refrigerant on the high-pressure side from the gas cooler 82. Since the refrigerant is accordingly heated by the refrigerant on the high-pressure side, a superheat degree of the refrigerant can be secured. Accordingly, the liquid refrigerant is sucked into the compressor 81, and a disadvantage of liquid compression can be avoided in advance. It is to be noted that the refrigerant which has flown out of the inner heat exchanger 88 repeats circulation in such a manner as to be sucked into the compressor 81.

On the other hand, by the blower fan 83, the air is heated by radiation of the high-temperature•pressure refrigerant in the gas cooler 82, and the drying air at high temperature flows into the hollow portion 9 from the duct member 67 of the air circulation path 72. The drying air which has flown into the hollow portion 9 is discharged into the housing chamber 10 from a discharge port.

The drying air discharged into the housing chamber 10 warms a matter to be dried stored in the inner drum 5 (housing chamber 10) to thereby evaporate humidity, and dries the matter to be dried. The moisture-containing air which has dried the matter to be dried passes through the housing chamber 10, flows to the outside of the inner drum 5 from the through holes (not shown), enters the duct member 68 of the air circulation path 72, and passes through the waste thread removing device 110. Here, the circulating air passed through the housing chamber 10 is sometimes mixed with the waste thread of the matter to be dried stored in the housing chamber 10. However, the waste thread can be removed from the circulating air which has flown out of the housing chamber 10 while passing through the waste thread removing device 110.

That is, the circulating air which enters the duct member 68 to thereby pass through the waste thread removing device 110 collides with the wall 112 disposed in such a manner that the flow of the circulating air is partially interrupted. By the collision with the wall 112, a part of the waste thread in the circulating air is separated from the circulating air. The circulating air which has hit the wall 112 passes through a gap formed between the wall 112 and the water pooled in the tank 114 formed below the wall, and flows on the opposite side (air passage 69 side) of the wall 112. Here, when the circulating air is passed through the gap formed between the wall 112 and the water in the tank 114, the waste thread in the circulating air is brought into contact with the water in the tank 114. Accordingly, the waste thread can be captured by the water in the tank 114, and separated from the circulating air.

The air which has passed through the waste thread removing device 110 is sucked into the air passage 69 from the inlet 69A, and introduced and passed into the evaporator 85 disposed in the passage.

The water content (water content evaporated from the dried matter) contained in the air from the housing chamber 10 is condensed on the surface of the evaporator 85 or the wall face of a wall 86 while passing through the evaporator 85, and drops as water droplets in a drain tank 89. The fallen droplets are discharged to an external discharge ditch or the like from the water discharge passage via a drain pipe (not shown) disposed under the drain tank 89.

The dried air from which humidity is removed by the evaporator 85 is sucked into the blower fan 83, and discharged toward the communication hole 94. Moreover, the air which has flown out of the communication hole 94 passes around the compressor 81. At this time, the air cooled by the evaporator 85, sucked into the blower fan 83, and discharged is passed around the compressor 81. Accordingly, the compressor 81 heated by the operation can be cooled.

Moreover, the air which has cooled the compressor 81 flows into the gas cooler 82, and is heated. Moreover, the air enters the duct member 67 from the outlet 69B of the air passage 69, and is sent to the hollow portion 9 of the shaft 8. In the same manner as described above, the air is discharged into the housing chamber 10 in the inner drum 5, the humidity is taken from the matter to be dried in the inner drum 5, and the matter is dried. This circulation is repeated.

On the other hand, when the drying operation is started, the control device starts controlling the opening/closing and open degrees of the lid member 122 and lid member 132 based on the temperature and humidity detected by the sensor 60 and outside air sensor as described above.

That is, when the outside air temperature detected by the outside air sensor is higher than circulating air temperature in the air circulation path 72 detected by the sensor 60, and outside air humidity is lower than a circulating air humidity, the control device opens the lid member 122 of the outside air introduction port 120 and the lid member 132 of the inner air discharge port 130. Accordingly, the outside air is introduced from the outside air introduction port 120, and can be mixed into the circulating air. The circulating air in the air circulation path 72, introduced from the outside air introduction port 120, can be discharged from the inner air discharge port 130. When the high-temperature low-humidity outside air is introduced from the outside air introduction port 120 and mixed with the circulating air in this manner, the water content that has to be recovered by the evaporator 85 can be reduced.

Furthermore, a difference between the outside air temperature and the circulating air temperature, or the difference between the outside air humidity and circulating air humidity further increases in a situation in which the outside air temperature is higher than the circulating air temperature, and the outside air humidity is lower than the circulating air humidity. In this case, the control device further increases the open degrees of the lid member 122 and the lid member 132.

Accordingly, the high-temperature low-humidity outside air is further introduced from the outside air introduction port 120, and low-temperature high-humidity circulating air introduced from the outside air introduction port 120 can be discharged from the inner air discharge port 130.

It is to be noted that in a case where the outside air temperature is lower than the circulating air temperature, or the outside air humidity is higher than the circulating air humidity, the open degrees of the lid members 122 and 132 are reduced, and the outside air introduction port 120 and the inner air discharge port 130 are totally closed by the lid members 122, 132.

By the above-described control, the dry air capable of raising the air temperature, discharged into the housing chamber 10, is circulated without introducing the outside air to thereby perform the drying operation. This advantage of the circulation system drying machine is maintained, while the water content that has to be recovered by the evaporator 85 can be reduced, and the matter to be dried can be efficiently dried. Since the outside air introduction amount is adjustable as described above, the outside air can be introduced more exactly.

It is to be noted that when the drying operation is executed for a predetermined time by the control device, the matter to be dried of the housing chamber 10 in the inner drum 5 is completely dried. The air in the air circulation path 72 is heated by the gas cooler 82 in this manner, and dehumidified by the evaporator 85 so that the matter to be dried can be efficiently dried in a short time. Therefore, energy efficiency is enhanced, and the constitution can further contribute to energy saving, for example, as compared with a case where the circulating air is heated by an electric heater or a gas burning heater, and water-cooled. Since a refrigerant indicating a supercritical pressure on the high-pressure side of the refrigerant circuit 95 is used such as carbon dioxide, a large heating capability can be obtained in the gas cooler 82.

As described above in detail, while maintaining the circulation system advantage that the air temperature discharged into the housing chamber 10 from the outside air introduction port 120 and the inner air discharge port 130 can be raised, the dried outside air is introduced and mixed in the circulating air. Consequently, the water content which has to be recovered by the evaporator 85 is reduced, and the matter to be dried can be efficiently dried in a short time.

Moreover, since the outside air introduction port 120 is disposed between the housing chamber 10 and the suction side of the blower fan 83, the air heated at high temperature in the gas cooler 82 is discharged into the housing chamber 10, and the outside air can be smoothly introduced from the outside air introduction port 120 by the blower fan 83.

Furthermore, since the outside air introduction port 120 is disposed on the air downstream side of the waste thread removing device 110, it is possible to solve a disadvantage that the outside air introduction port 120 is clogged with the waste thread in the circulating air.

It is to be noted that in the present embodiment, the opening/closing and open degrees of the lid member 122 of the outside air introduction port 120 and the lid member 132 of the inner air discharge port 130 are controlled by the temperature and humidity detected by the sensor 60 and outside air sensor. However, the present invention is not limited to this embodiment. An amount or type of the matter to be washed, temperature of the refrigerant flowing through the refrigerant circuit 95 and the like may be used alone or combined to thereby control the respective lid members 122, 132.

Embodiment 2

Next, another embodiment of a drying machine to which the present invention is applied will be described with reference to FIG. 4. It is to be noted that in FIG. 4, components denoted with the same numerals as those of FIGS. 1 to 3 produce similar effects.

Figure 4:
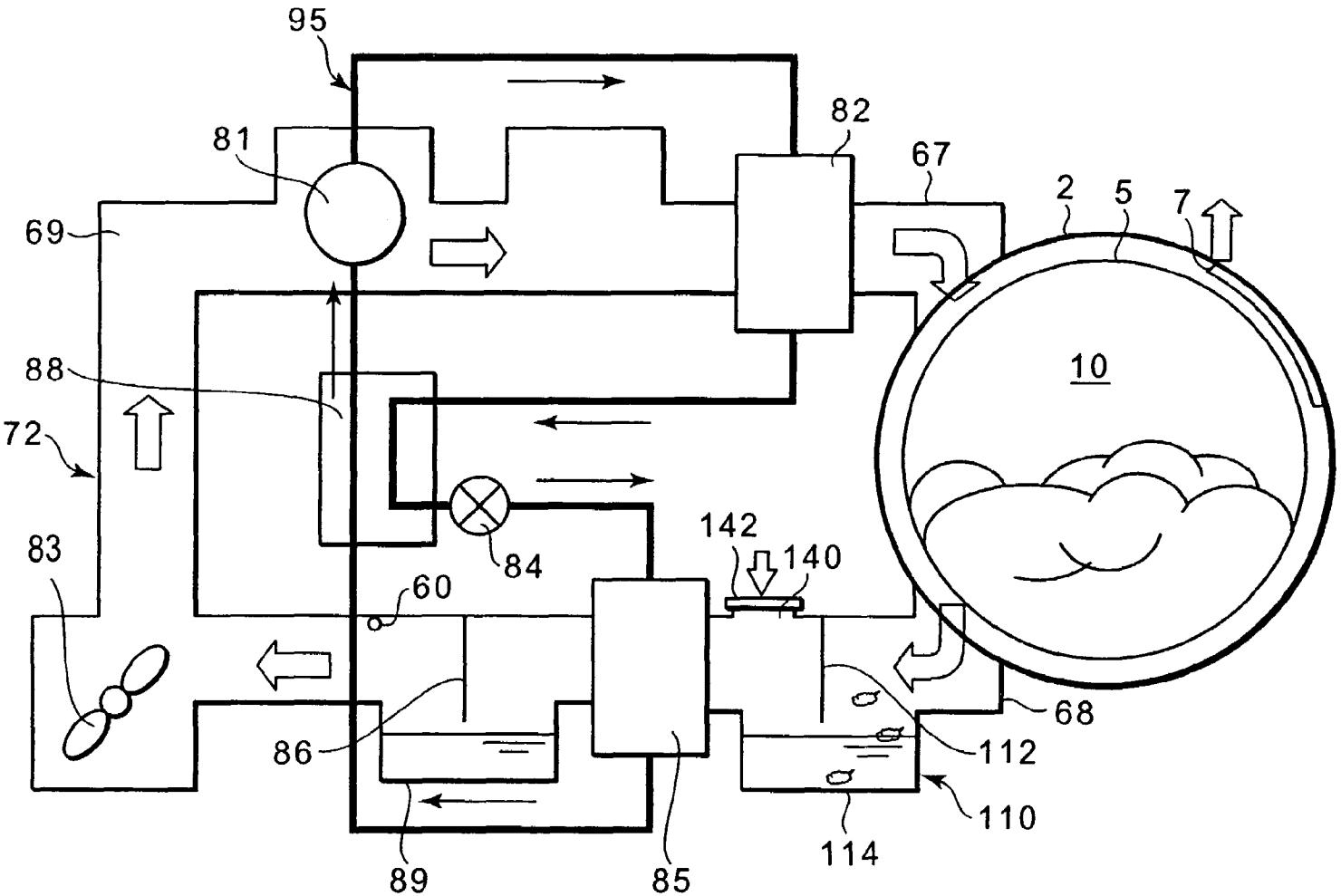
FIG. 4 is a diagram showing the flows of the refrigerant and air in a washing/drying machine according to another embodiment of the present invention.

In FIG. 4, reference numeral 140 denotes an outside air introduction port in the present embodiment, and this outside air introduction port 140 is formed between a housing chamber 10 and an evaporator 85 and in a duct member 68 on an air downstream side of a waste thread removing device 110. This outside air introduction port 140 is a port for mixing outside air with air circulating in a air circulation path 72, and a lid member 142 is openably attached to an opening. Opening/closing and open degree of the lid member 142 are controlled by a control device in the same manner as in the above-described embodiment. That is, the control device controls the opening/closing and open degree of the lid member 142, and adjusts an outside air introduction amount from the outside air introduction port 140 based on the temperature or humidity detected by a sensor 60 and an outside air sensor.

Moreover, at least a part of an open/close lid 7 of an outer drum 2 of the present embodiment is openable/closeable, and a part of a circulation path extends from the open/close lid 7 at a drying operation time. That is, a spring member (not shown) or the like for urging and pushing up the open/close lid 7 from below is attached to a bottom part of the open/close lid 7, and an urging force of the spring member is controlled by the control device. Moreover, the control device usually sets a spring urging force to be smaller than gravity applied to the open/close lid 7. When the outside air introduction port 140 is opened, the urging force of the spring is increased, and the urging force of the spring is set to be larger than the gravity applied to the open/close lid 7. Accordingly, the open/close door 3 opens, and a part of the circulating air flow to the outside from the opened part of the open/close door 3. The control device adjusts the urging force of the spring based on the open degree of the outside air introduction port 140, and can discharge the circulating air introduced from the outside air introduction port 140 from the open/close lid 7.

Even when the outside air introduction port 140 is formed between the housing chamber 10 and the evaporator 85 and in the duct member 68 on the air downstream side of the waste thread removing device 110 in this manner, the dried outside air is smoothly introduced from the outside air introduction port 140, and can be mixed in the circulating air. The water content that has to be recovered by the evaporator 85 can be reduced. Consequently, the matter to be dried can be efficiently dried in a short time.

Furthermore, even in the present embodiment, the outside air introduction port 140 is disposed on the air downstream side of the waste thread removing device 110. Therefore, a disadvantage that the outside air introduction port 140 is clogged with the waste thread in the circulating air can be solved.

Moreover, in the present embodiment, at least a part of the open/close lid 7 is openable/closeable, and a part of the circulating air flows out in cooperation with the control of the outside air introduction port 140. In this constitution, any special air outflow portion for discharging the circulating air does not have to be disposed, and the circulating air of the open/close lid 7 can flow out.

It is to be noted that also in the present embodiment, the opening/closing and open degrees of the lid member 142 of the outside air introduction port 140, and the open/close lid 7 are controlled by the temperature and humidity detected by the sensor 60 and outside air sensor in the same manner as in the above-described embodiment. However, the present invention is not limited to this embodiment. An amount or type of the matter to be washed, temperature of the refrigerant flowing through the refrigerant circuit 95 and the like may be used alone or combined to thereby control the lid member 142 and the open/close lid 7.

Moreover, in the above-described embodiments, the drying air is heated and dehumidified using the refrigerant circuit. The present invention is not limited to this embodiment. The present invention is also effective for a drying machine using an electric heater or a water-cooling•air-cooling heat exchanger. In the embodiments, the present invention is applied to a washing/drying machine having washing and drying functions, but may be, needless to say, applied to a drying machine having an only drying function.

What is claimed is:

1. A drying machine provided with a housing chamber which houses a matter to be dried, and executing a drying operation of the matter to be dried in the housing chamber, the drying machine comprising:

an outer drum; an inner drum; heating means; dehumidifying means; blowing means; an air circulation path for discharging air heated by the heating means into the housing chamber by the blowing means, sending the air passed through the housing chamber into the dehumidifying means, and circulating the air in the heating means;

said inner drum is disposed inside said outer drum and is constituted as said housing chamber, said air circulation path which extends from an air outlet of the housing chamber to an air inlet of the housing chamber, is defined by an air duct assembly connected to the outer drum in such a manner as to communicate with the housing chamber; and an outside air introduction port formed in the air duct assembly so that air outside of the air duct assembly is mixed into the air circulating in the air circulation path.

2. A drying machine provided with a housing chamber which houses a matter to be dried, and executing a drying operation of the matter to be dried in the housing chamber, the drying machine comprising:

an outer drum; an inner drum; heating means; dehumidifying means; blowing means; an air circulation path for discharging air heated by the heating means into the housing chamber by the blowing means, sending the air passed through the housing chamber into the dehumidifying means, and circulating the air in the heating means;

said inner drum is disposed inside said outer drum and is constituted as said housing chamber, said air circulation path which extends from an air outlet of the housing chamber to an air inlet of the housing chamber, is defined by an air duct assembly connected to the outer drum in such a manner as to communicate with the housing chamber;

an outside air introduction port formed in the air duct assembly so that air outside of the air duct assembly is mixed into the air circulating in the air circulation path; and a refrigerant circuit constituted by successively piping/connecting a compressor, a gas cooler, a pressure reducing device, and an evaporator in an annular shape, the gas cooler constituting the heating means, the evaporator constituting the dehumidifying means.

3. The drying machine according to claim 1 or 2, wherein the outside air introduction port is closably formed.

4. The drying machine according to claim 1 or 3, wherein the outside air introduction port is disposed between the housing chamber and a suction side of the blowing means.

5. The drying machine according to claim 4, wherein the outside air introduction port is disposed between the housing chamber and the dehumidifying means.

6. The drying machine according to claim 5, further comprising: waste thread removing means which is disposed between the housing chamber and the dehumidifying means and which removes waste thread in a circulating air, wherein the outside air introduction port is disposed on an air downstream side of the waste thread removing means.

7. The drying machine according to claim 1 or 2, wherein an outside air introduction amount from the outside air introduction port is adjustable.

8. The drying machine according to claim 1 or 2, further comprising: an openable/closeable lid for inserting/removing the matter to be dried with respect to the housing chamber, wherein a part of the circulating air flows out of a lid portion.

* * * * *